United States Patent [19]

Upadhya et al.

[11] Patent Number: 4,972,449

[45] Date of Patent: Nov. 20, 1990

[54] X-RAY TUBE TARGET

[75] Inventors: Kamleshwar Upadhya, Glendale; Thomas C. Tiearney, Jr., Waukesha, both of Wis.; William F. Banholzer, Glenville, N.Y.

[73] Assignee: General Electric Company, Milwaukee, Wis.

[21] Appl. No.: 495,890

[22] Filed: Mar. 19, 1990

[51] Int. Cl.[5] ..... H01J 35/10

[52] U.S. Cl. ..... 378/144; 378/143

[58] Field of Search ..... 378/143, 144, 127

[56] References Cited

U.S. PATENT DOCUMENTS

| | | | |
|---|---|---|---|
| 4,132,916 | 1/1979 | Hueschen et al. | 313/330 |
| 4,392,238 | 7/1983 | Lersmacher et al. | 378/144 |
| 4,573,185 | 2/1986 | Lounsberry et al. | 378/144 |

*Primary Examiner*—Craig E. Church

*Attorney, Agent, or Firm*—Quarles & Brady

[57] ABSTRACT

An x-ray tube target has improved heat dissipation by applying a layer of diamond between the focal track and the target body. The diamond layer can be applied directly to a graphite target body, a graphite disc covered with silicon carbide or to a disc composed of an molybdenum alloy such as TZM.

14 Claims, 2 Drawing Sheets

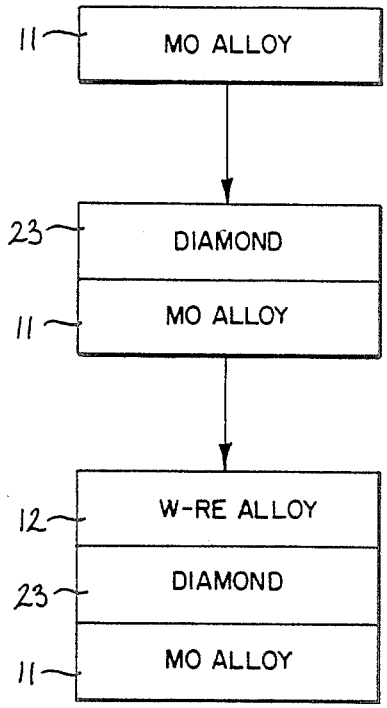
FIG. 4
FIG. 5
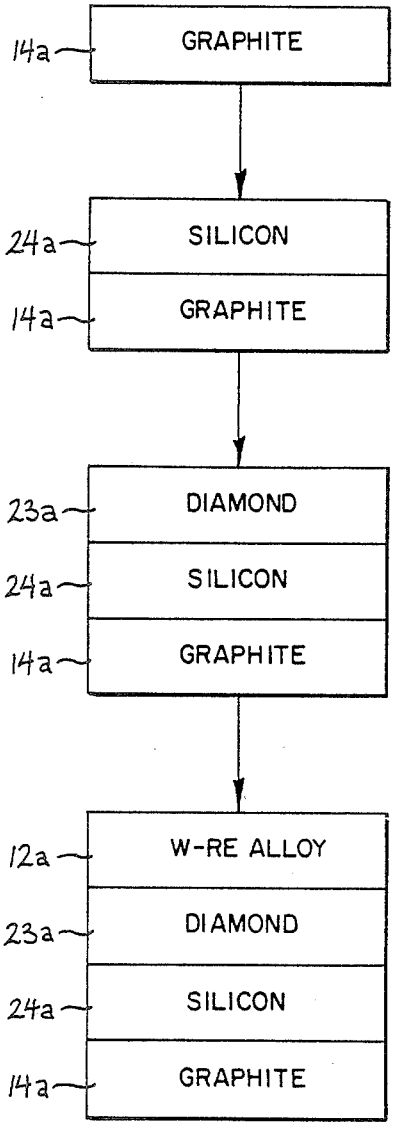
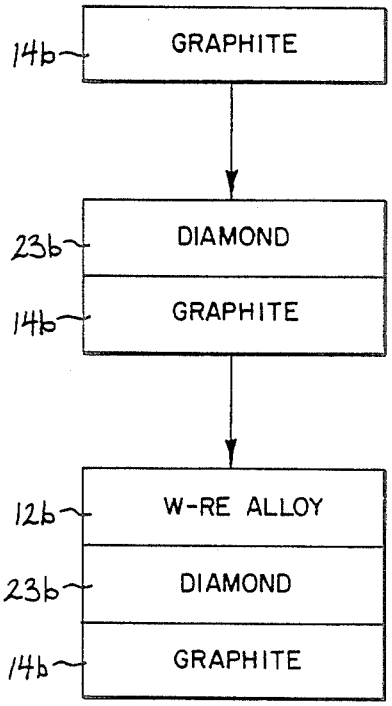
FIG. 6

X-RAY TUBE TARGET

BACKGROUND OF THE INVENTION

This invention relates generally to x-ray tube anode targets and, more particularly to rotating anode targets with high heat dissipation.

As stated in U.S Pat. No. 4,132,916 which is commonly assigned and the teachings of which are incorporated by reference, it is well known that of the total energy involved in an electron beam striking an x-ray target, only 1% of the energy is converted into x-ray radiation with the remainder of about 99% being converted into heat. The power flux under the electron beam on the x-ray target is extremely high making rotation of the target at 10,000 rpm necessary to avoid melting the tungsten on the focal track used to generate the x-rays. In view of this high generation of heat, it is necessary to dissipate the heat from the focal track so as not to destroy the anode target. This heat dissipation to be effective should disperse the heat energy under the beam on the target as well as to transfer the heat out of the target area. This is effected in conjunction with circulating oil in a casing as described in U.S. Pat. No. 4,132,916.

Most x-ray tubes rely on fast rotation of the target to spread the energy in the beam out over the entire target. The thermal conductivity of the tungsten in the focal track aids in conducting heat away from the electron beam impact point.

In U.S. Pat. No. 4,392,238, pyrolytic graphite layers are employed to dissipate heat from a focal track in a rotary anode for an x-ray tube. However, there is a need to improve the heat dissipation of an x-ray tube target.

It is, therefore, an object of the present invention to provide an improved x-ray target with higher heat dissipation than those readily available.

Another object of the present invention is to provide a layer of diamond under the target focal track so as to dissipate the energy under the electron beam and over the target.

Still another object is to provide a method for producing in situ a diamond layer on an x-ray tube anode.

These objects and other features and advantages will become more readily apparent upon reference to the following description when taken in conjunction with the appended drawings.

SUMMARY OF THE INVENTION

Briefly, in accordance with one aspect of the present invention, a graphite or refractory metal anode body has a surface region on the anode body composed of an x-ray generating metallic layer for being impinged by electrons. A diamond layer is disposed between the x-ray generating metallic layer and the anode body.

In one embodiment of the invention, the anode body is composed of a molybdenum-based alloy with the diamond layer placed between the metallic layer and the molybdenum-based alloy body.

In other embodiments, the anode body is composed of graphite alone and in one aspect has a layer of silicon carbide placed over the graphite body with the diamond layer placed between the metallic layer and the silicon carbide layer. In another aspect, the diamond layer is disposed directly on the graphite body.

According to various aspects of the invention, the diamond layer can be applied by various in situ methods such as plasma assisted chemical vapor deposition (CVD). Generally, the diamond should be applied with a film thickness in the range of 4–400 mils; the temperature of the deposition process should be in the range of 600°–1100° C. and the pressure should be in the range of 5–100 torr for the plasma enhanced CVD process.

In the drawings as hereinafter described, preferred embodiments are depicted. However, various other modifications and alternate constructions can be made thereto without departing from the true spirit and scope of the invention.

BRIEF DESCRIPTION OF THE DRAWINGS

FIGS. 4–6 are flow diagrams showing the process of target fabrication in accordance with the preferred embodiments of the invention.

DESCRIPTION OF THE PREFERRED EMBODIMENTS

Figure 1:
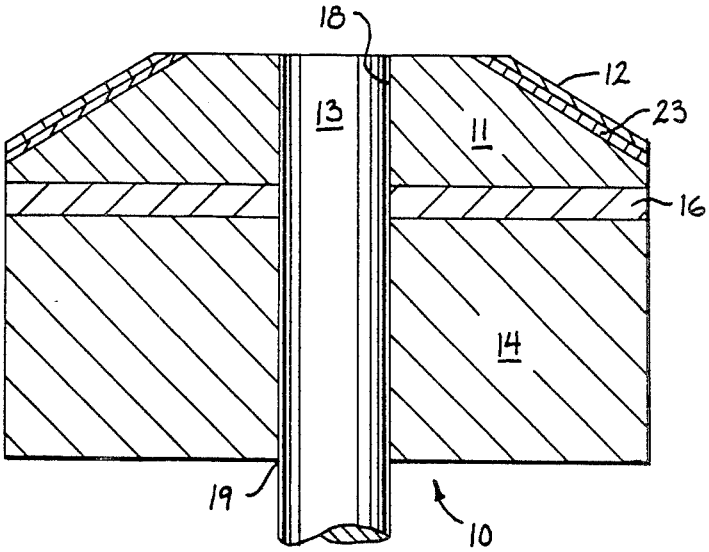
FIG. 1 is a sectional view of one embodiment of an x-ray target made in accordance with the invention.

Referring now to FIG. 1, there is shown a target, or anode assembly generally 10, for use as a rotating anode x-ray tube in accordance with the invention. The assembly 10 includes a metal disc portion 11 having a focal track 12 applied to a forward face thereof for producing x-rays when bombarded by the electrons from a cathode in a conventional manner. The disc 11 is composed of a suitable refractory metal such as molybdenum or molybdenum alloy such as TZM or MT104. The conventional focal track 12 disposed thereon is composed of a tungsten or a tungsten/rhenium alloy material. The disc 11 as well as a graphite disc portion 14 have central bores 18 and 19 and are placed over a stem 13. The disc 11 is attached by a conventional method, such as brazing, diffusion bonding, or mechanical attachment.

The graphite disc 14 is attached to a rear face of the metal disc 11 by a platinum braze, indicated generally at 16, in a manner described in U.S. Pat. No. 4,802,196, which is commonly assigned. The primary purpose of the graphite disc 14 is to provide a heat sink for the heat which is transferred through the metal disc 11 from the focal track 12. It is best if the heat-sink function can be provided without contributing significantly to the mass of the target assembly.

It should be particularly noted that between the focal track 12 and the disc portion 11 is a layer of diamond 23. The purpose of the diamond layer 23 is to dissipate heat produced when an electron beam hits the focal track 12. The high thermal conductivity of the diamond will not only spread the heat under the electron beam but will help conduct it to the outside of the target where it can be transferred to the tube wall by radiation.

The diamond layer 23 is preferably 4–400 mils in thickness. It is applied using a plasma CVD process wherein the plasma is excited in a hydrogen-rich methane gas mixture. The temperature of the metal disc portion 11 should be approximately 1000° C. and the deposition process conducted in an atmosphere having a pressure of 5–100 torr and a temperature in the range of 600°–1100° C. Subsequently, a tungsten rhenium layer is also applied in a customary manner by the CVD process to form the focal track 12. It has a thickness of 30–35 mils. A flow diagram illustrating the steps in the fabrication of anode assembly 10 is shown in FIG. 4. The same numbers indicate the same components except they are shown diagramatically.

Figure 2:
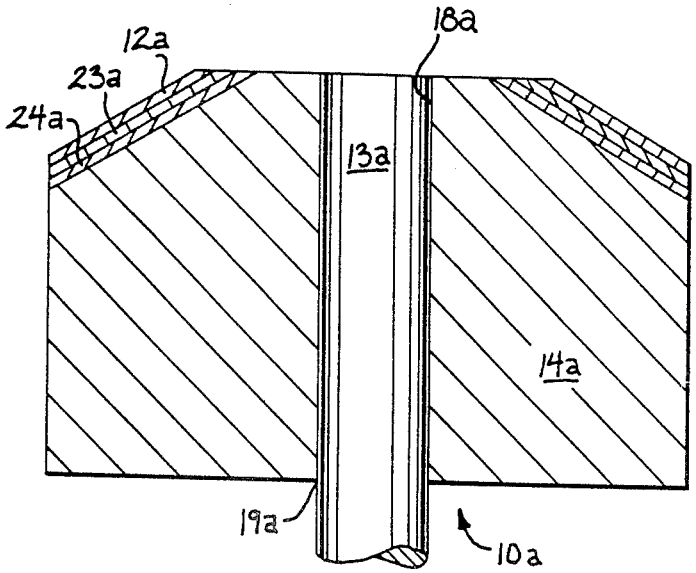
FIGS. 2 and 3 are views similar to FIG. 1 showing additional embodiments.
Figure 3:
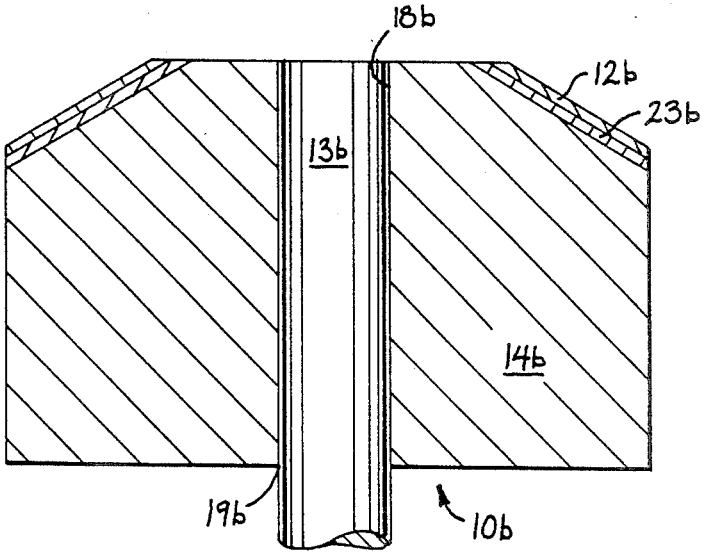

There are shown in FIGS. 2 and 3 additional embodiments generally 10*a* and 10*b*. Similar components are referred to by the same numbers except followed by the letters "a" and "b". The diamond layers 23*a* and 23*b* are applied in the same manner as indicated for diamond layer 23.

Unlike embodiment 10, embodiments 10*a* and 10*b* do not have the separate disc portions 11 but instead employ single graphite disc portions 14*a* and 14*b*. The connection of the disc portions 14*a* and 14*b* to the stems 13*a* and 13*b* is made by brazing or mechanical attachment. In the instance of embodiment 10*a*, it will be seen that there is a layer of silicon carbide 24*a* placed between the diamond layer 23*a* and the graphite disc portion 14*a*. This layer of silicon carbide is applied by the CVD or plasma assisted CVD processes so as to result in a thickness of 5–7 microns. It serves the purpose of increasing the rate of growth of diamond, controlling the grain structure of diamond as well as improving the adhesion of diamond to the substrate. In place of the silicon carbide layer 24*a* other intermediate layers could be substituted such as those composed of refractory metals or carbides thereof, for example, tantalum or tungsten carbide. FIG. 5 illustrates the sequence of steps for producing this embodiment.

Referring specifically to FIG. 3, this embodiment 10*b* illustrates the diamond layer 23*b* disposed between the focal track 12*b* and an anode body 14*b*. The high bond density of the diamond in this embodiment should help to reduce the formation of tungsten carbide which has a tendency to form between the focal track 12*b* and the graphite disc portion 14*b*. FIG. 6 illustrates the sequence of steps for producing this embodiment.

Computer modeling simulations were performed using 20 and 10 mil thick diamond films deposited on graphite targets as shown in FIG. 3. For equivalent power loadings, the surface temperature of a target is reduced approximately 200° C. with a 20 mil diamond layer thickness under a 30 mil focal track layer 12*b* compared to a 30 mil focal track layer 12*b* alone. For a 10 mil diamond layer under a 20 mil focal track the surface temperature of the target was reduced 134° C.

The plasma assisted CVD process is the preferred method of applying the diamond layers 23, 23*a* and 23*b*. However, other in situ methods can be employed such as the well known hot filament CVD method or microwave plasma assisted CVD; electron assisted CVD, including RF assisted CVD; plasma assisted physical vapor deposition; ion beam deposition; sputtering; the use of DC plasma torches, and atmospheric hydrocarbon-oxygen combustion flame; or any other deposition technique for diamond known to those skilled in the art. While, the diamond should be applied with a film thickness in the range of 4–400 mils, any thickness desirable to optimize target performance can be used. The temperature of the deposition process should be in the range of 600°–1100° C. and the pressure should be in the range of 5–100 torr for the plasma enhanced CVD process. However, other processing conditions known to those skilled in the art could also be employed. In the previous description, the diamond layers 23, 23*a* and 23*b* have been described as being deposited in a manner using an in situ process such as the plasma assisted CVD process. If desired, a diamond layer could be applied on a sacrificial substrate such as silicon with the diamond being subsequently removed such as by dissolving in an appropriate solution or liquid. The diamond layer could then be brazed to the substrate.

While this invention has been described with reference to particular embodiments and examples, other modifications and variations will occur to those skilled in the art in view of the above teachings. Accordingly, it should be understood that within the scope of the appended claims the invention may be practiced otherwise than as specifically described.

We claim:

1. An x-ray tube anode comprising:

a graphite or refractory metal body having a surface region on said body composed of an x-ray generating metallic layer for being impinged by electrons; and a diamond layer disposed between said x-ray generating metallic layer and said body.

2. The anode as defined in claim 1 wherein said body is composed of a molybdenum-based alloy.

3. The anode as defined in claim 1 wherein said body is graphite.

4. The anode as defined in claim 1 wherein said x-ray generating metallic layer is composed of a tungsten-rhenium alloy.

5. The anode as defined in claim 1 wherein a layer of silicon carbide is disposed between said diamond layer and said graphite body.

6. The anode as defined in claim 1 wherein said diamond layer is present in the range of 4–400 mils.

7. A method of manufacturing an anode for an x-ray tube comprising:

placing a diamond layer on a surface region of a graphite or refractory metal body; and placing an x-ray generating metallic layer over said diamond layer.

8. The method as defined in claim 7 wherein said diamond layer is produced in situ.

9. The method as defined in claim 8 wherein said diamond layer is produced by chemical vapor deposition.

10. The method as defined in claim 8 wherein said diamond layer is produced by a plasma assisted chemical vapor deposition.

11. The method as defined in claim 10 wherein the plasma is excited in a hydrogen-rich methane gas mixture.

12. The method as defined in claim 7 wherein said diamond layer is produced employing a sacrificial substrate.

13. A method of manufacturing an anode for an x-ray tube comprising:

placing a layer of a refractory metal or carbide thereof on a surface region of a graphite body;

producing in situ a diamond layer over said layer of said refractory metal or carbide thereof; and placing an x-ray generating metallic layer over said diamond layer.

14. The method as defined in claim 13 wherein said refractory metal or carbide thereof is silicon carbide.

* * * * *